US005930913A

United States Patent [19]

Liao et al.

[11] Patent Number: 5,930,913

[45] Date of Patent: Aug. 3, 1999

[54] PORTABLE SHOE DEHUMIDIFIER

[76] Inventors: Li-Wen Liao; Chung-Min Liao, both of 928 N. Marguerita Ave., Alhambra, Calif. 91801

[21] Appl. No.: 08/987,296

[22] Filed: Dec. 9, 1997

[51] Int. Cl.[6] ..... F26B 25/00

[52] U.S. Cl. ..... 34/104; 34/202

[58] Field of Search ..... 34/104, 202

[56] References Cited

U.S. PATENT DOCUMENTS 4,768,293 9/1988 Kaffka ..... 34/104

5,570,515 11/1996 Schulte ..... 34/104

*Primary Examiner*—Henry A. Bennett

*Assistant Examiner*—Malik N. Drake

[57] ABSTRACT

This invention is a shoe dehumidifier, which consists of an air-processing unit and an air-distribution unit. The two units are joined through a retractable air duct. A fan and a heating element are located on the top portion of the air-processing unit. Air is drawn into the air-processing unit by the fan, and is then warmed and dehumidified by the heating element. Through the air duct, heated air is guided into air-distribution unit and driven into the shoe. Air routing grooves outside the air-distribution unit then evenly guide heated air to different locations inside the shoe, achieving an overall drying effect. The design of the retractable air duct allows the unit to be folded making it easy to transport and store.

3 Claims, 3 Drawing Sheets

PORTABLE SHOE DEHUMIDIFIER

BACKGROUND—FIELD OF INVENTION

This invention is a shoe dehumidifier, which consists of an air-processing unit and an air-distribution unit. The two units are joined through a retractable air duct. A fan and a heating element are located on the top portion of the air-processing unit. Air is drawn into the air-processing unit by the fan, and is then warmed and dehumidified by the heating element. Through the air duct, warm air is guided into the air-distribution unit and driven into the shoe. Air routing grooves outside the air-distribution unit then evenly guide heated air to different part of the shoe, achieving an overall drying effect. The design of the retractable air duct allows the unit to be folded making it compact and easy to transport.

BACKGROUND

"Global village" is no longer a new term to most people. Today, people travel more often than ever before. Numerous travelers' accessories and kits were therefore developed and mass merchandised. Travelers, especially those, whose feet sweat a lot, often find their feet uncomfortable after wearing the same pair of shoes for an extended period of time. Moisture absorbed by the shoe from sweaty feet and wet weather can often lead to the growth of athlete's foot fungi inside the shoes. If one consistently wears wet shoes, foot ordor, burning, and itching may result. Eventually, these symptoms may lead to the development of athlete's foot.

OBJECTS AND ADVANTAGES

To resolve the above-described situation, it is an objective of the present invention to provide a portable shoe dehumidifier. This shoe dehumidifier will help users to eliminate the bad shoe odor, remove the excess moisture, and prevent the athlete's foot fungi from growing inside the shoes.

DRAWING FIGURES

In the drawings, closely related figures have the same number.

REFERENCE NUMERALS IN DRAWINGS

| | |
|---|---|
| 10 air-processing unit | 11 air inlet |
| 12 fan grill | 13 air duct |
| 14 connector | 140 hinge |
| 141 hinge pin | |
| 20 air-distribution unit | 21 connector |
| 22 air duct | 23 air passageways |
| 24 air outlet | 25 air routing grooves |
| 30 fan | 31 motor |
| 32 fan blades | |
| 40 heating element | |
| 50 power input socket | |
| 60 power converter | |
| 70 power socket | |
| 80 power cable | |

DESCRIPTION OF THE EMBODIMENT

Figure 1:
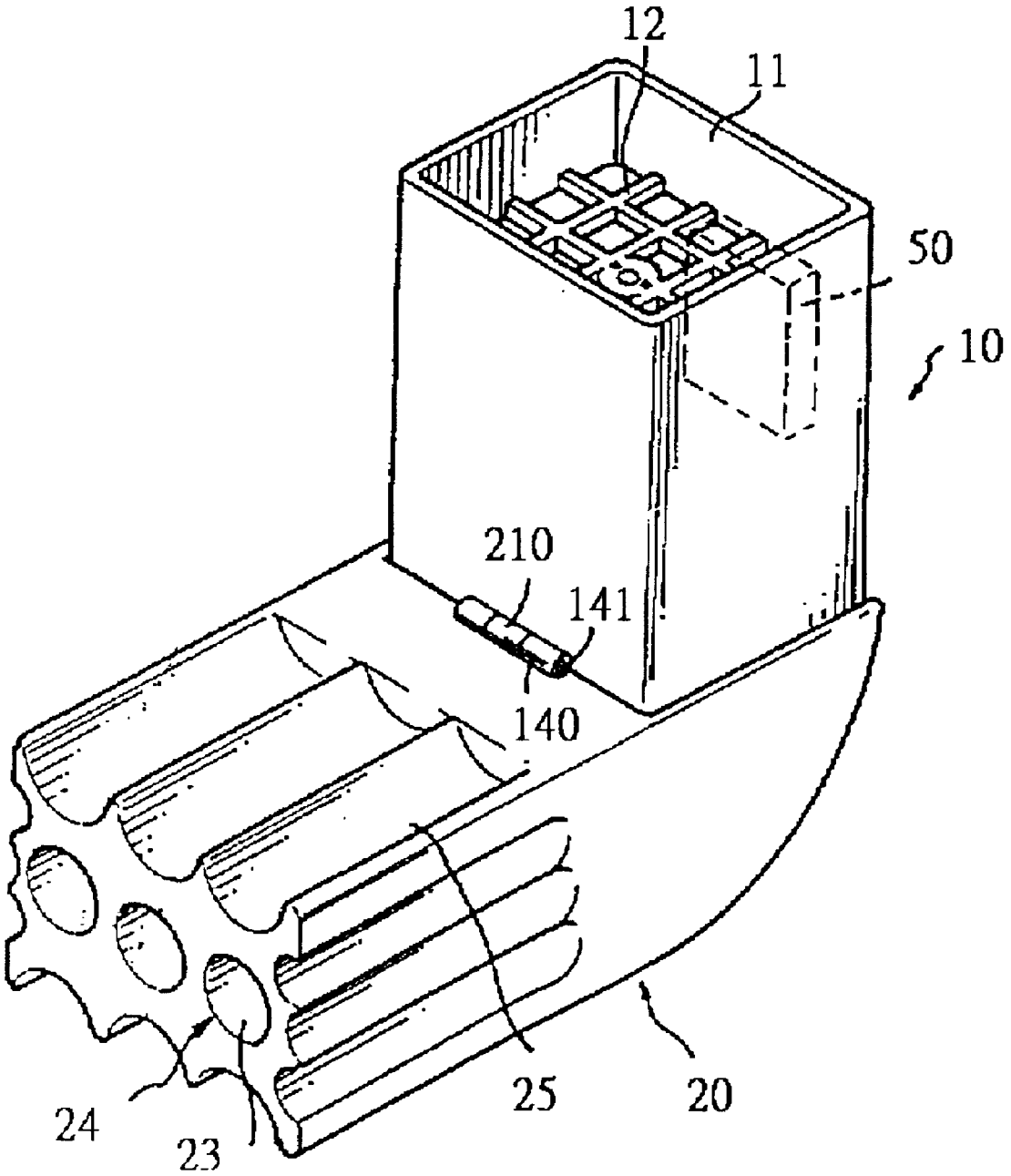
FIG. 1 shows a perspective view of the shoe dehumidifier.
Figure 2:
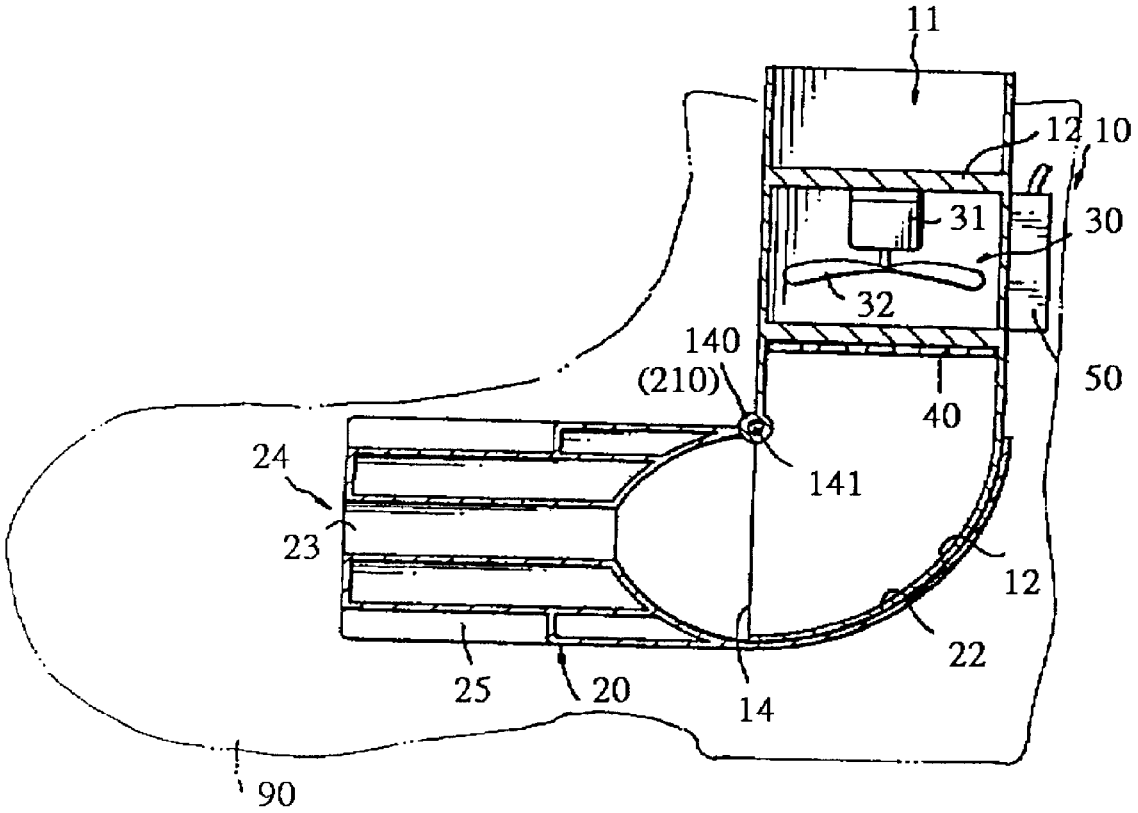
FIG. 2 shows a cross sectional view of the shoe dehumidifier positioned inside a shoe.
Figure 3:
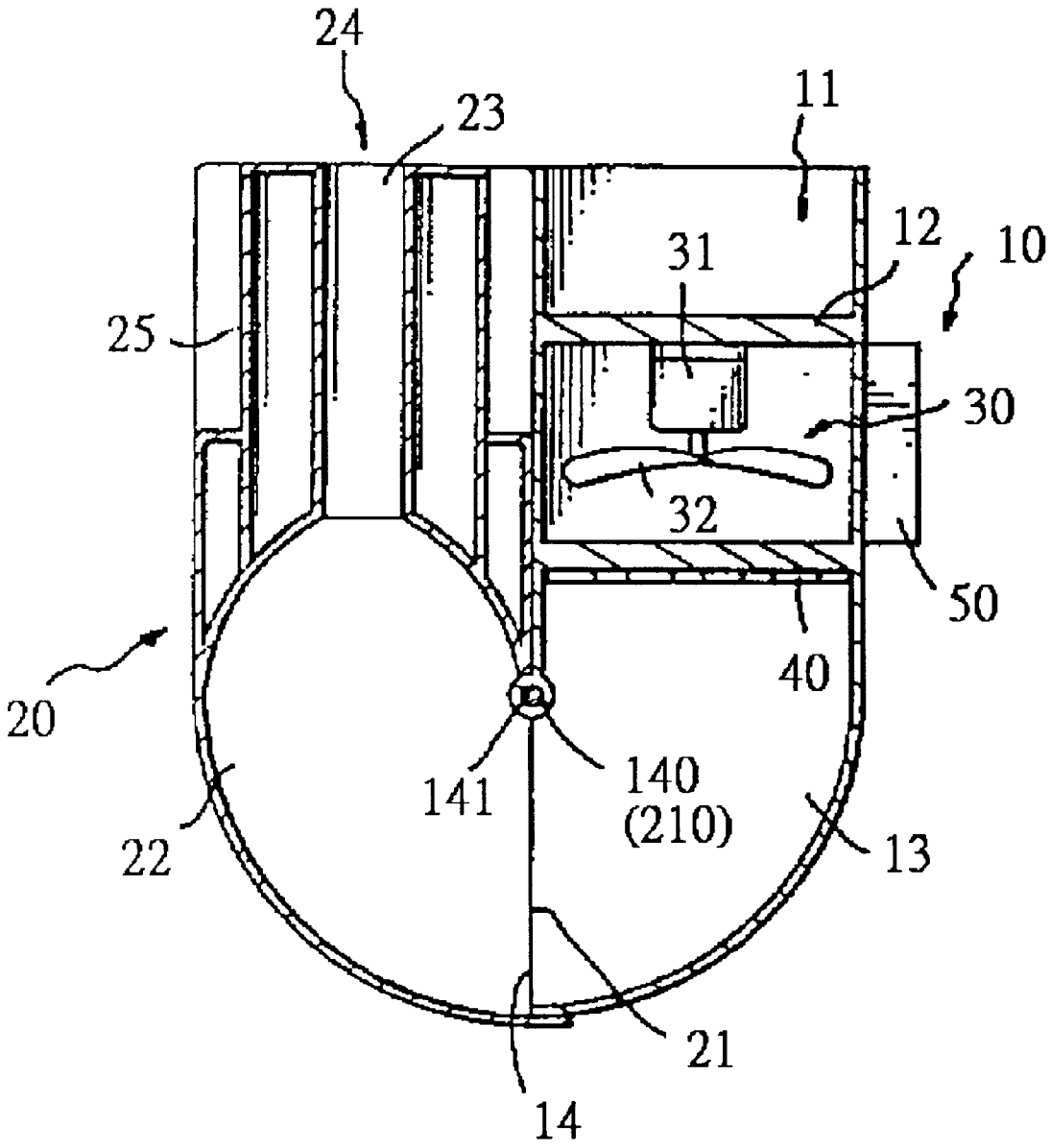
FIG. 3 shows a cross sectional view of the retracted shoe dehumidifier.

Please refer to FIG. 1, FIG 2, and FIG. 3 for the following description of the embodiment. The shoe dehumidifier consists of an air-processing unit (10) and an air-distribution unit (20). The upper end of the air-processing unit is the air inlet (11). A fan (30) is placed near the air inlet, beneath the fan grill (12). A heating element (40) is located underneath the fan.

Outside the air-processing unit is a power input socket (50) which receives power from an external power converter (60) through a power cable (80). The external power converter receives power directly from the power socket (70) on the wall.

The lower portion of the air-processing unit is an air duct (13), which partially overlaps with the air duct (22) of the air-distribution unit, forming a retractable joining of the air-processing unit and air-distribution unit. The joining is then secured by a hinge (140).

The air-distribution unit contains one air duct (22) and three air passageways (23). Numerous air routing grooves (25) were made on the surface of the air-distribution unit.

First, the fan (30) draws the air into the air-processing unit (10). Note that the grill (12) on top of the fan is used to prevent foreign objects from falling into the shoe dehumidifier. Next, air is pushed through the heating element (40), and becomes dehumidified and warm. The warm air is then guided by the air ducts (13) and (22) to the air passageways (23). Through these air passageways, warm air is driven to the inner tip of the shoe. When air hits the tip of the shoe, it is then deflected toward the rear of the shoe, moving along the inner walls of the air routing grooves (25) on the sides of the air-distribution unit. These grooves (25) evenly and omni-directionally guide warm air to different locations inside the shoe, achieving an overall drying effect. The design of the retractable air duct (13) (22) also helps to reduce the size of the shoe dehumidifier, which makes it easy to transport and store (FIG. 3).

Summary

A number of advantages of the portable shoe dehumidifier become evident:

(a) Ease of use. Users simply plug in the power and set the timer, an optional feature.

(b) Compact and easy to transport. When folding the air-processing unit and air-distribution unit toward each, the size of the shoe dehumidifier is significantly decreased as shown in FIG. 3.

(c) High efficiency. With the help of air routing grooves (25), warm air is able to travel to all locations inside the shoe, achieving an overall drying effect.

We claim:

1. A portable shoe dehumidifier comprising of an air-processing unit which has an air inlet at the upper end, a fan which locates near the air inlet and beneath the fan grill, a heating element which locates underneath the fan, and an air-distribution unit which contains one air duct, three air passageways, and numerous air routing grooves on the outside surface.

2. The portable shoe dehumidifier of claim 1, wherein the two air ducts partially overlap each other, forming a retractable joining of the air-processing unit and air-distribution unit.

3. The portable shoe dehumidifier of claim 1, wherein timer and temperature setting control could be incorporated into the circuitry design.

* * * * *